US007143708B1

(12) United States Patent
Cimino

(10) Patent No.: US 7,143,708 B1
(45) Date of Patent: Dec. 5, 2006

(54) BOAT FENDER MOUNTING DEVICE

(76) Inventor: William J. Cimino, 325 Rice Ave., Revere, MA (US) 02151

( * ) Notice: Subject to any disclaimer, the term of this patent is extended or adjusted under 35 U.S.C. 154(b) by 0 days.

(21) Appl. No.: 11/330,741

(22) Filed: Jan. 13, 2006

(51) Int. Cl.
*B63B 59/02* (2006.01)

(52) U.S. Cl. ..... 114/219; 114/218; 24/115 R

(58) Field of Classification Search ..... 114/218, 114/219, 364; 24/115 R, 115 A, 130
See application file for complete search history.

(56) References Cited

U.S. PATENT DOCUMENTS 2,292,140 A * 8/1942 Lofgren ..... 24/130
4,280,435 A * 7/1981 Loomis ..... 114/219
4,302,869 A * 12/1981 Hackney ..... 24/115 R
4,895,094 A * 1/1990 Carlstedt ..... 114/218
5,660,133 A * 8/1997 Munich ..... 114/219
6,152,060 A * 11/2000 Steiner ..... 114/219

* cited by examiner

*Primary Examiner*—Lars A. Olson
(74) *Attorney, Agent, or Firm*—William Nitkin

(57) ABSTRACT

A boat fender mounting device having a planar member with a slot defined therein for receipt and retention of a rail/cable and at least one rope aperture for receipt and retention of the first end of a rope for supporting a boat fender at its second end at a desired height against the hull of a boat.

2 Claims, 6 Drawing Sheets

BOAT FENDER MOUNTING DEVICE

BACKGROUND OF THE INVENTION

1. Field of the Invention

The present invention relates to an improved boat fender mounting device and more particularly relates to a boat fender mounting device of the type that engages onto the rail or lifeline cable of a boat and has at least one aperture for receipt and retention of one end of a rope extending therefrom which rope is adjustable in length and has a boat fender attached at its other end.

2. History of the Prior Art

When a boat is docked, cylindrical boat fenders are hung from the sides of the boat and positioned between the boat and the dock so as to prevent the boat from scraping against the dock. A rope usually suspends each boat fender at the desired vertical position so that they are best positioned at the hull's points of contact with the dock. Many devices have been developed to suspend boat fenders at the proper position and to avoid the difficulties of tying the boat fender's rope in a knot around a cleat, cable or rail as it is often difficult for some individuals to tie and especially untie such ropes if wet. Some of such devices are taught by Boat Fender Hanger of Hurt, U.S. Pat. No. 5,493,983; One Piece Anchor for Adjustably Tethering a Rope Suspended Boat Fender of Loomis, U.S. Pat. No. 4,280,435; and Hooker Cleat of Steiner, U.S. Pat. No. 6,152,060. The Fender Mounting System and Method for Boats by Munich, U.S. Pat. No. 5,600,133 teaches a mounting block that is mounted on a stanchion of a railing of a boat to which block a rope, attached to the boat fender, is engaged to position the boat fender at the desired height.

SUMMARY OF THE INVENTION

It is an object of this invention to provide an improved boat fender mounting device which is quick and easy to use both for mounting and removing the boat fender from its mounted position as well as for adjusting the length of rope for the vertical positioning of the fender at the desired height. The boat fender mounting device of this invention can be a planar member having first and second ends and first and second sides. A pair of opposing first and second finger slots are defined, respectively, in the first and second sides so that the device can be easily grasped and maneuvered by inserting the user's index finger and middle finger within their respective finger slots with the balance of the device at the first end forming a handle fitting within the palm of the user's hand. An aperture is defined in the second end of the boat fender mounting device, such second end including an entry way which opens to a retention area defined in the central portion of the device. At least one rope aperture is defined in the planar member adjacent to the retention area the entry way for receipt of the rope that is attached to a fender. The width of the narrowest portion of the entry way forms a narrower opening than the width of the retention area, and the retention area is of sufficient size to receive the rail or lifeline cable therein. The entry way at the second end can have inwardly angled sides to accommodate receipt of the rail/cable therein, the inwardly angled sides terminating near the narrowest width of the entry way where the sides angle outward toward the widest width of the retention area. In the embodiment used on a sailboat having a lifeline cable therearound, the entry way defined in the central portion of the device is narrower than the entry way used on a rail, as described in greater detail below. The device, being made of a resilient and somewhat flexible plastic-like material, allows the sides of the entry way to be spread apart when the rail/cable passes into the retention area. The boat fender mounting device of this invention is then held in place on the rail/cable by the sides of the entry way returning to their original spaced apart position by such resiliency of its material, thus retaining the boat fender mounting device on the rail/cable until the device is later pulled off the rail/cable, when desired.

A rope having first and second ends is used with this invention. The second end of the rope is attached to a boat fender. The first end of the rope is passed through at least one rope aperture, being the first rope aperture, and is pulled therethrough. Once the boat fender mounting device is in position on a rail/cable, the rope is adjusted so that the boat fender is in the desired position between the boat and the dock. A knot is then tied in the second end of the rope above the top of the boat fender mounting device which knot is wider than the diameter of the first rope aperture so that when the rope is released, the knot acts as a stop, preventing further downward movement of the rope through the first rope aperture, thereby fixing the rope at that length with the boat fender in place at the desired position. In some embodiments the boat fender mounting device can include a second rope aperture defined in the planar member adjacent to the first rope aperture for the rope to first pass upwards through the first aperture and then downwards through the second rope aperture for easier adjustment of the rope length and retention of the rope. A knot can still be tied in the rope and a ring, described below, can be used to loosen the rope from the boat fender mounting device, when required.

When one wishes to remove the boat fender, one grasps the handle portion of the boat fender mounting device by putting one's index and middle fingers into the first and second finger slots and pulling the boat fender mounting device off the rail/cable, causing the device at the narrowest width of the entry way to be forced apart by the rail/cable passing therethrough after the rail/cable passes out the retention area.

DESCRIPTION OF THE PREFERRED EMBODIMENT(S)

Figure 1:
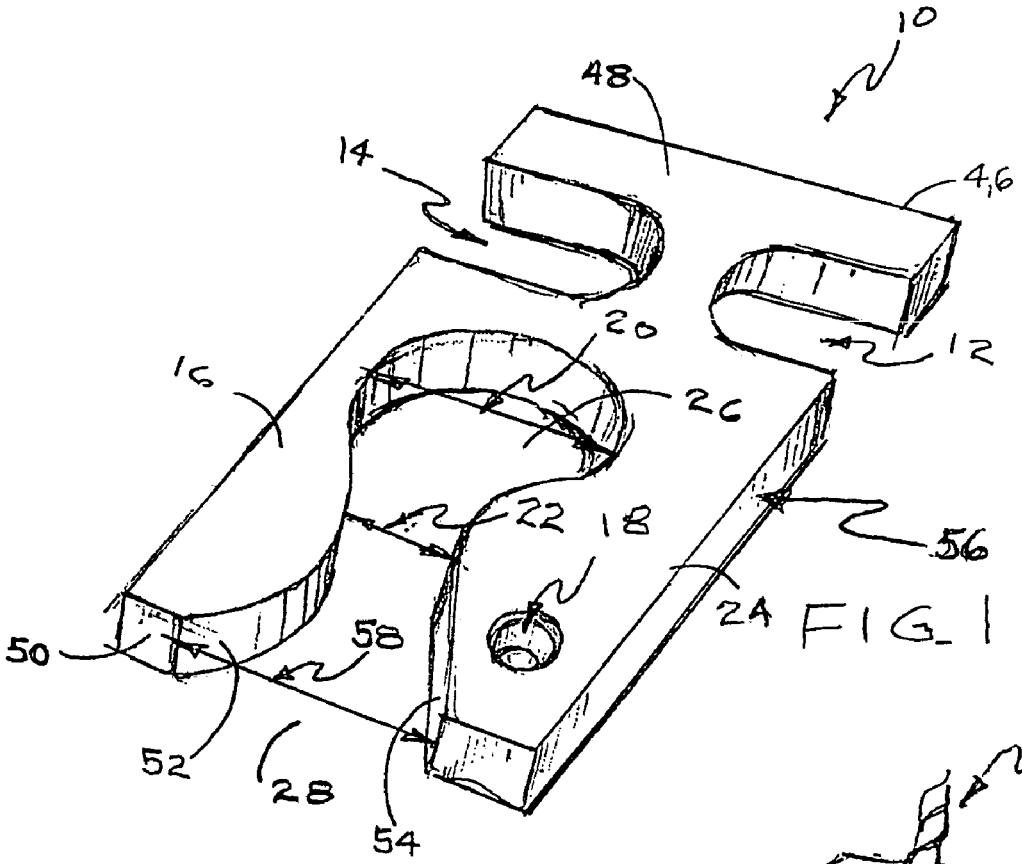
FIG. 1 illustrates a perspective view of one embodiment of the boat fender mounting device of this invention.
Figure 2:
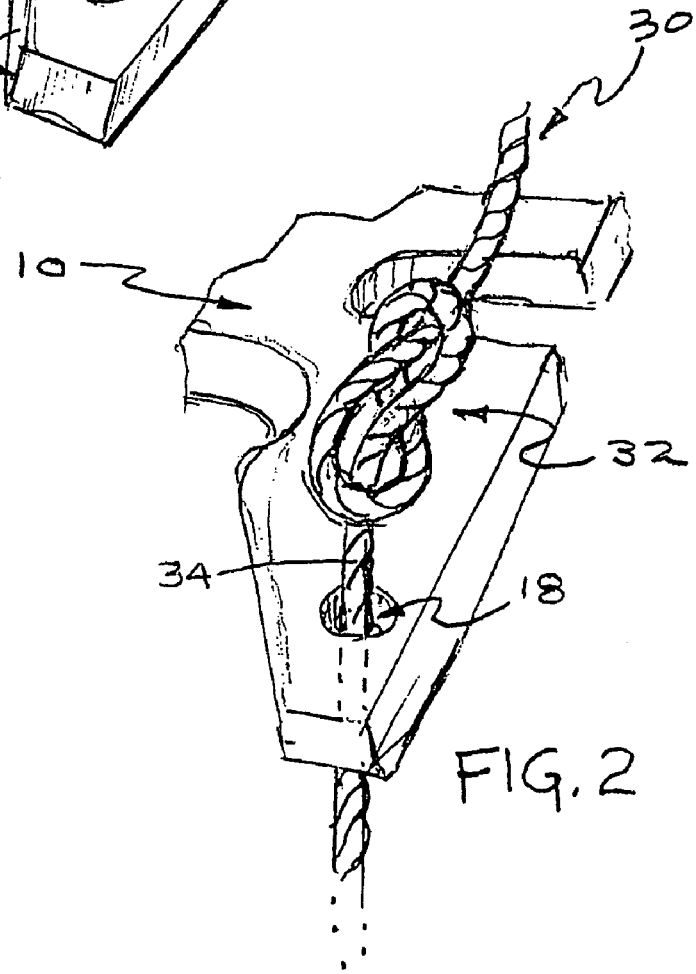
FIG. 2 illustrates a perspective view of a portion of the boat fender mounting device of FIG. 1, showing the second end of a rope passed through a rope aperture.
Figure 3:
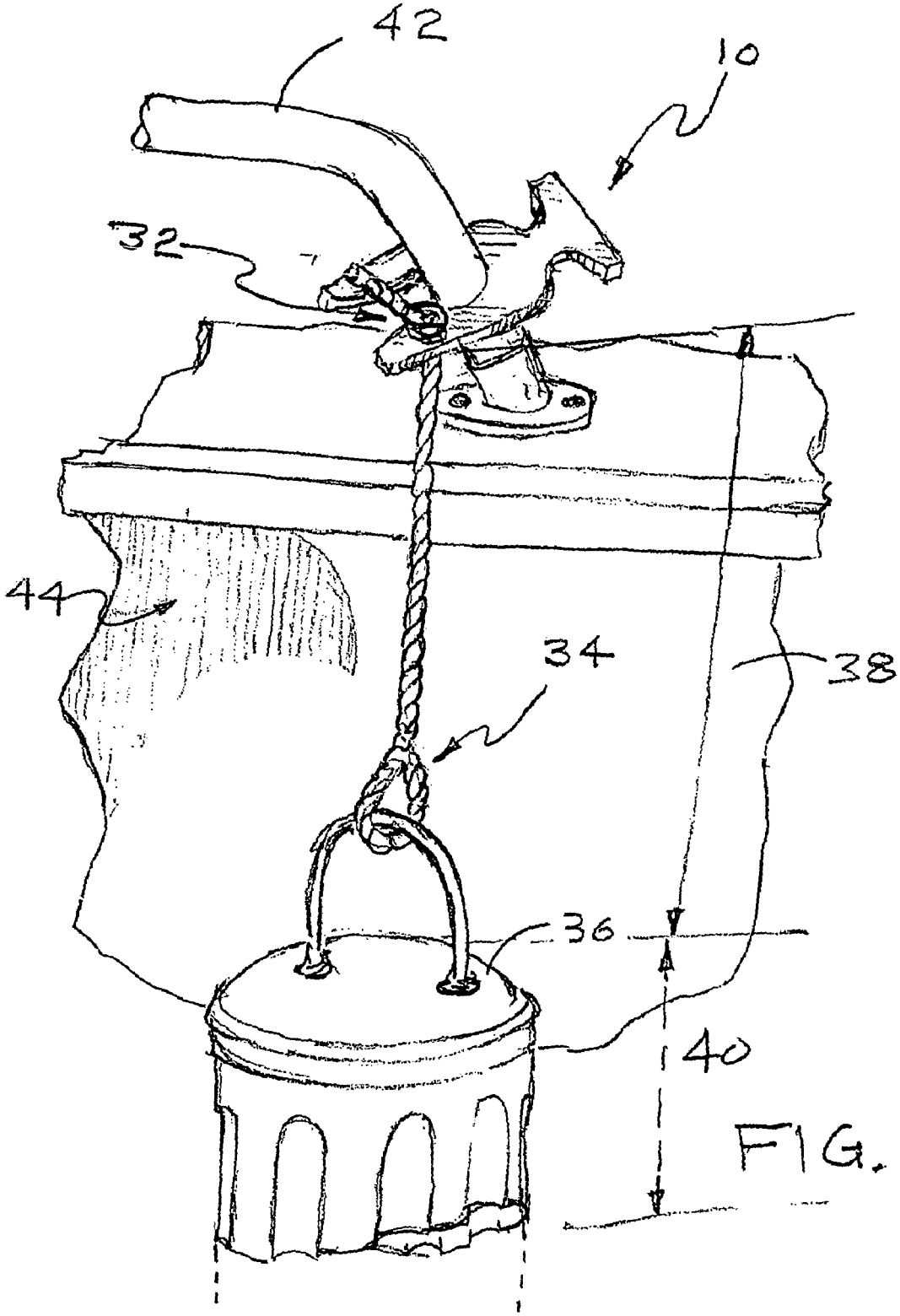
FIG. 3 illustrates a side view of a portion of a power boat showing the boat fender mounting device mounted on the rail of the boat with a fender attached by a rope thereto.
Figure 4:
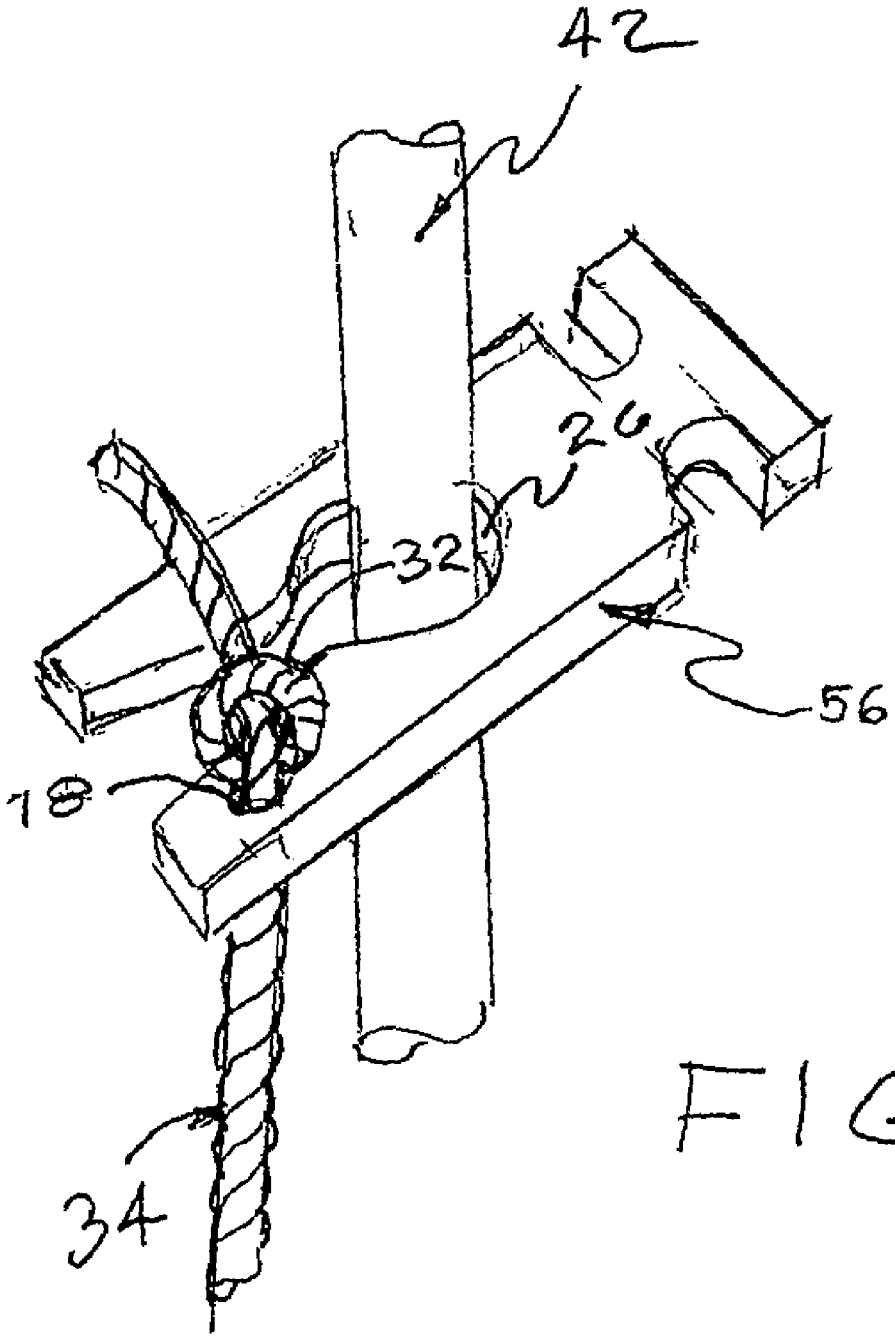
FIG. 4 illustrates a perspective view of the boat fender mounting device of this invention mounted on a boat's rail showing a rope disposed within its rope aperture and knotted to position a fender, not shown, at a desired position.

FIG. 1 illustrates a perspective view of boat fender mounting device 10 of this invention. Seen in this view is planar body 56 having first and second ends 48 and 50 and first and second sides 16 and 24. Defined in first and second sides 16 and 24, respectively, are first and second finger slots 14 and 12 near first end 48. First and second finger slots 14 and 12 can be engaged by the index and middle finger of the user with first end 48 forming handle member 46 so that the device can be easily held and maneuvered with direct force by the user. Second end 50 of planar member 56 has defined therein entry way 28 having an opening width 58 and first and second side walls that are inwardly angled to retaining width 22. The opening of entry way 28 leads to a bulbous-shaped opening referred to herein as retention area 26 having a width 20 and a constricted opening at its base being retaining width 22. Retaining width 22 is narrower than width 20. Width 20 of retention area 26 is wide enough to accommodate the diameter of rail 42 of power boat 44, as seen in FIG. 3, and in a preferred embodiment the retention area can be generally round with an opening extending to second end 50. Rails and cables are defined herein to include stanchions which hold such rails and cables and to which stanchions the device of this invention can also be attached. Rail 42 entering entry way 28 would fit between inwardly angled first and second side walls 52 and 54 and would spread apart first and second sides 16 and 24 of boat fender mounting device 10 until rail 42 passes through retaining width 22 into retention area 26 wherein the first and second sides 16 and 24 would spring back to their original position due to their natural resiliency and hold the rail within retention area 26. The device of this invention can be slid along rail 42, as seen in FIG. 3, or can be stopped, in one embodiment, by a portion of boat 44. First rope aperture 18 is defined in planar body 56 in an area approximately adjacent to retention area 26 and entry way 28. First rope aperture 18 is of sufficient diameter to receive therein rope 34 which, as seen in FIG. 2, passes therethrough and is then tied in knot 32 when the rope distance 38, as seen in FIG. 3, positions boat fender 36 at the desired height 40 beside boat 44 and any dock or other structure that is adjacent to the boat. FIG. 4 shows the device of this invention positioned on a rail 42 with rope 34 held in place by knot 32. When one wishes to remove the device of this invention, one grasps handle member 46 with one's index and middle fingers, respectively, within first and second finger slots 14 and 12 and pulls the boat fender mounting device off rail 42.

Figure 5:
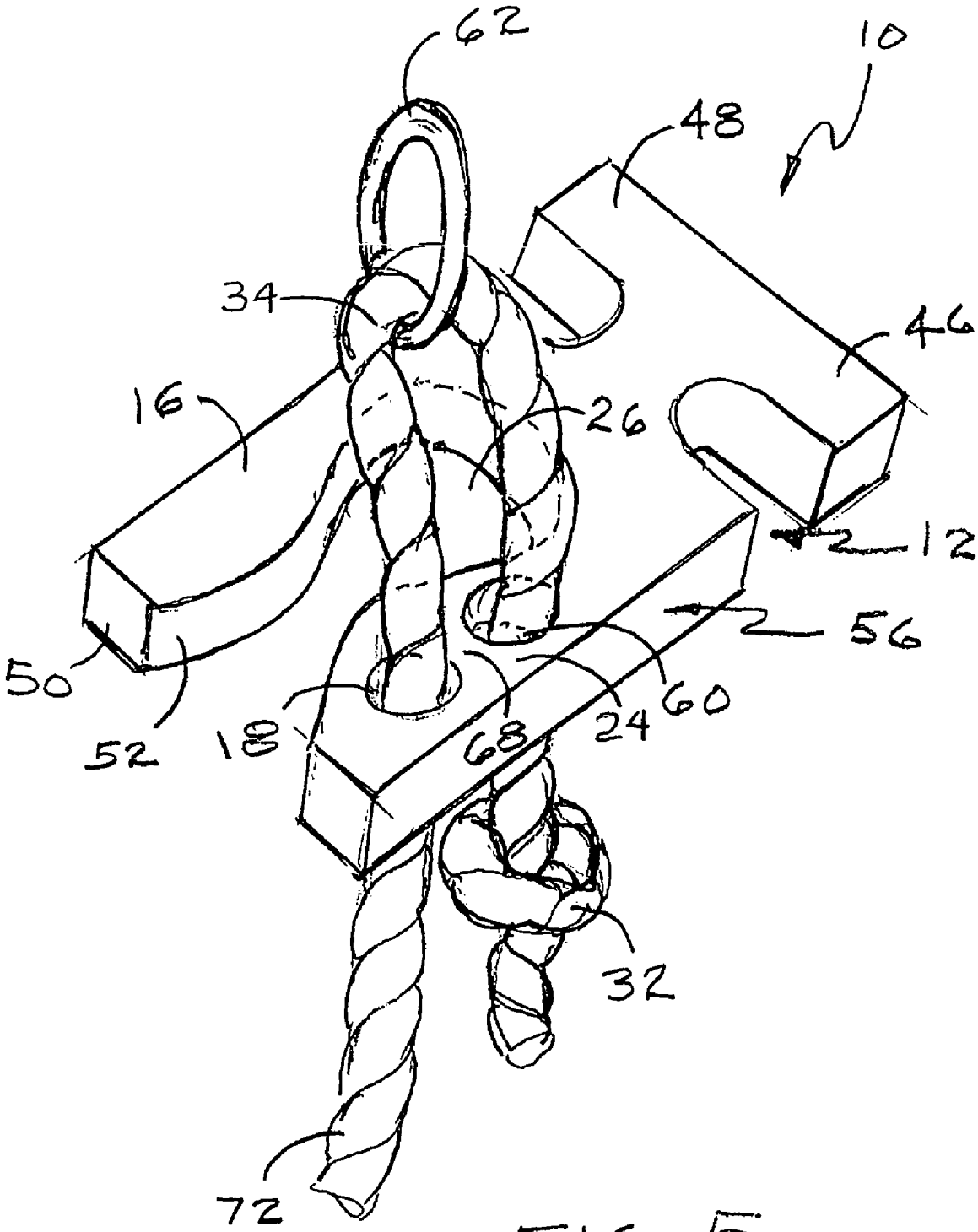
FIG. 5 illustrates a perspective view of an alternate embodiment of the device of this invention having first and second rope apertures.

FIG. 5 illustrates a perspective view of an alternate embodiment of this invention having second rope aperture 60 disposed adjacent to first rope aperture 18. First and second rope apertures 18 and 60 are defined within the body of boat fender mounting device 10 with such apertures spaced apart from one another a distance 68. In use, one passes the first end of rope 34 upwards through first rope aperture 18 and then passes the rope downward through second rope aperture 60. By tightening the rope between these apertures snugly against the top of second side 24, the rope 34 can be held in place so that the second end of rope 34 to which the boat fender is attached can be at the desired distance to support the boat fender at the proper height. Knot 32 can optionally be placed at the first end of rope 34 to prevent it from slipping back out through second rope aperture 60. Ring 62 can optionally be placed around rope 34 so that when rope 34 is tightened in position into first and second rope apertures 18 and 60 and passed over distance 68 in close proximity to the top of second side 24, ring 62 will press against the top of second side 24 over the area of distance 68, allowing for easy grasping and pulling of ring 62 when rope 34 is tightly held in position and difficult to otherwise grasp. Once ring 62 is pulled upwards, it loosens rope 34 from its engagement within first and second rope apertures 18 and 60. After knot 32 is undone, rope 34 can be easily removed from, or readjusted in position on, boat fender mounting device 10.

Figure 6:
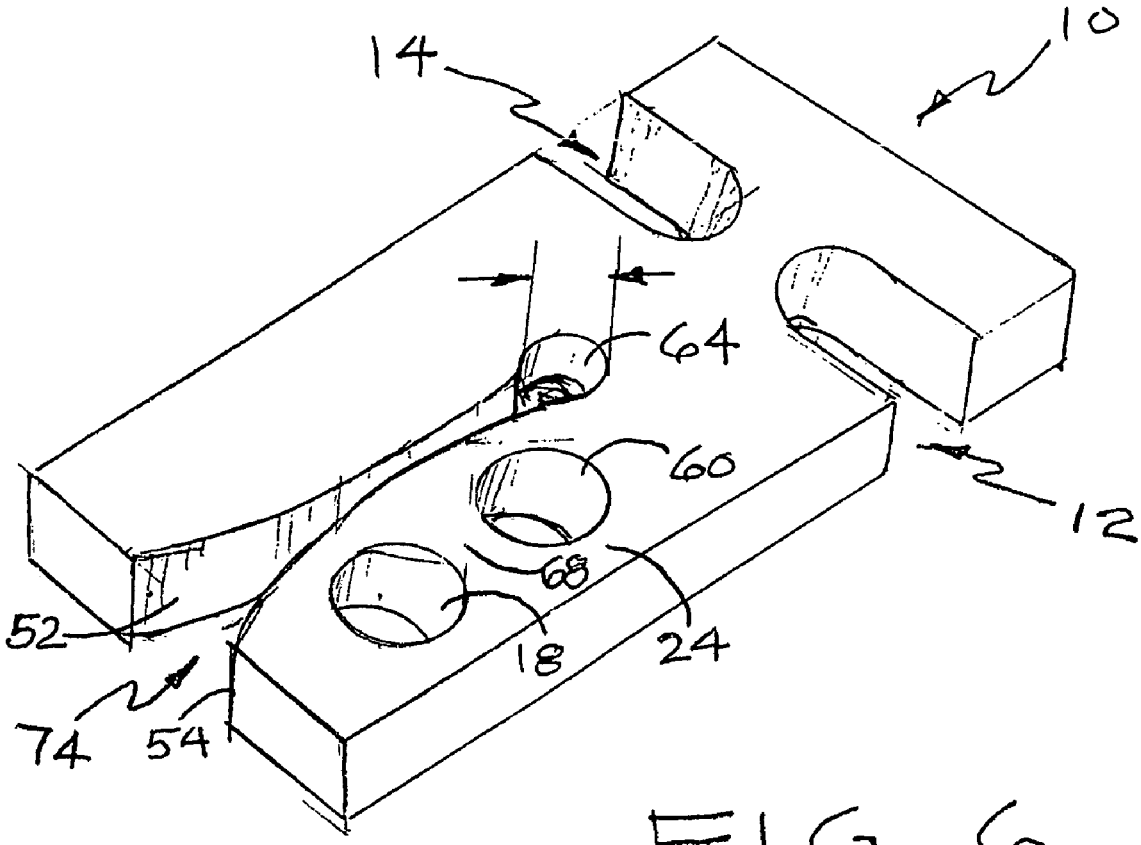
FIG. 6 illustrates a perspective view of an alternate embodiment of the device of this invention having first and second rope apertures for use on a sailboat's lifeline cable.
Figure 7:
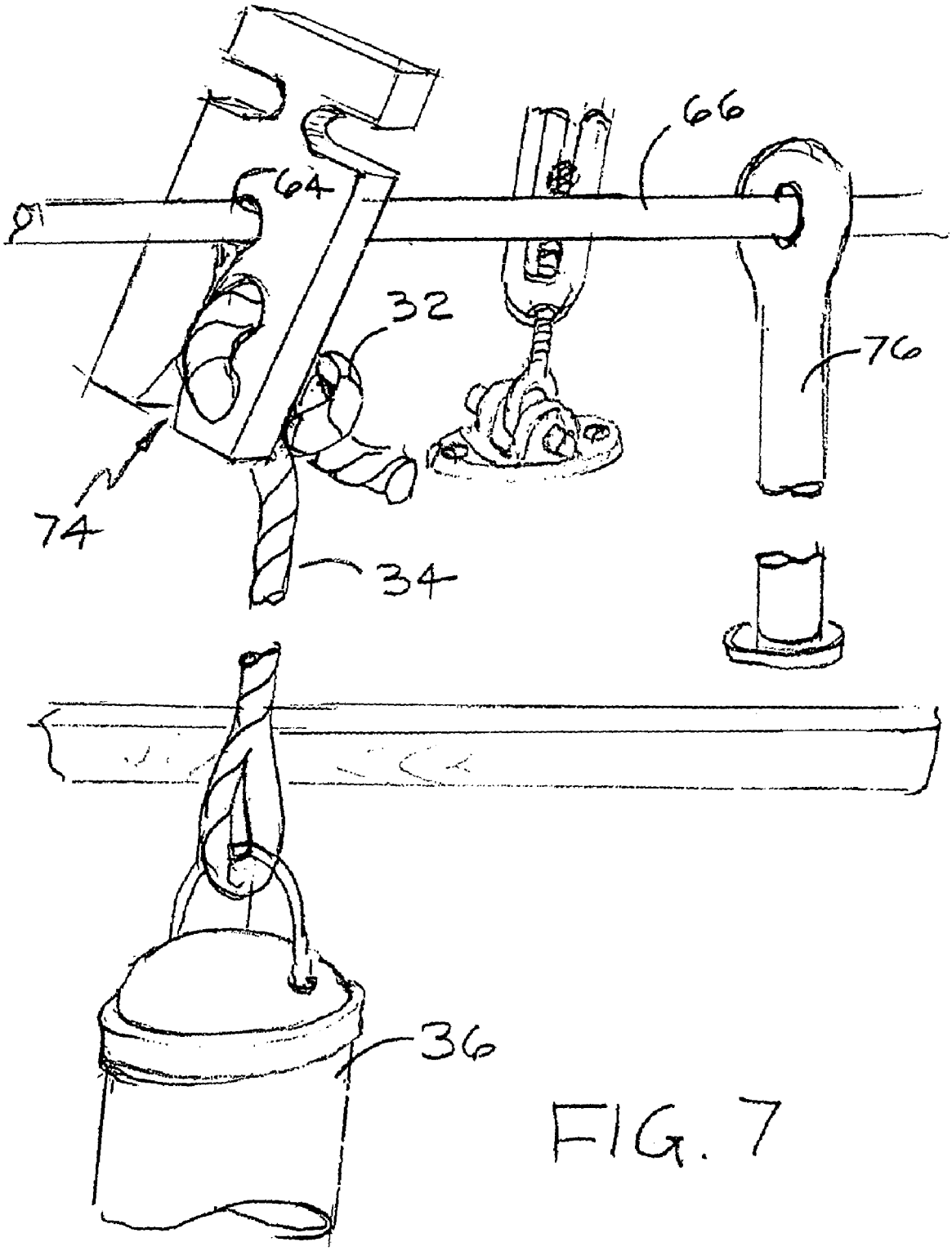
FIG. 7 illustrates a perspective view of a portion of a sailboat showing the boat fender mounting device of this invention attached to a sailboat's lifeline cable.

A sailboat generally has a lifeline cable disposed around its perimeter which has a narrower diameter than the diameter of a rail on a power boat. In an alternate embodiment of this invention, as seen in FIGS. 6 and 7, cable retention area 64 having a smaller diameter than the diameter of retention area 26, is defined in boat fender mounting device 10 with a cable entry way 74 defined therein to allow the device to be pushed down on a cable with the cable passing within cable entry way 74 which is narrower than the diameter of the cable but which first and second side walls 52 and 54 are spread apart by the passage of the cable into cable receipt area 64 wherein, as described above, first and second side walls 52 and 54 of cable entry way 74 return to their original position, thereby retaining the cable within cable retention area 64 until boat fender mounting device 10 of this invention is removed by pulling on handle member 46 to remove it from cable 66. FIG. 7 illustrates a perspective view of a portion of a sailboat showing the boat fender mounting device of this invention attached to the sailboat's lifeline cable and lifeline cable 66 supported by a stanchion 76 holding boat fender 36 attached to rope 34 at the desired distance against the hull of the sailboat.

Although the present invention has been described with reference to particular embodiments, it will be apparent to those skilled in the art that variations and modifications can be substituted therefor without departing from the principles and spirit of the invention.

I claim:

1. A boat fender mounting device for mounting on the rail or lifeline cable of a boat for positioning a boat fender attached to a rope having first and second ends at a desired position against the hull of the boat, comprising:

a planar member made of a resilient material having first and second ends and first and second sides;

first and second finger slots defined, respectively, in said first and second sides, said first and second finger slots positioned opposite one another;

a handle member formed between said first and second finger slots and said first end;

an entry way opening defined at said second end of said planar member, said entry way having first and second side walls that are inwardly angled to form a retaining width that is wide enough to receive said rail/cable therethrough when said first and second side walls are spread apart;

a retention area opening defined in said planar member further inward of and in communication with said entry way and said retaining width, said retention area opening having a diameter that is greater than the diameter of said rail/cable for receipt of said rail/cable after said rail/cable has passed through said entry way opening and said retaining width, said planar member being sufficiently resilient to return said first and second side walls to their non-spread apart condition to retain said rail/cable in said retention area opening; and a first rope aperture defined in said planar member, said first rope aperture having an aperture width sufficient to receive said first end of said rope therethrough wherein a knot tied in said first end of said rope is of sufficient width to retain said knot above said planar member and position said boat fender attached to said second end of said rope at a desired position against the hull of said boat, said planar member removable from said rail/cable when said handle member is grasped and said device is pulled away from said rail/cable, said rail/cable passing out of said retention area opening, through said retaining width and out said entry way opening, said first and second side walls being spread apart by the movement therethrough of said rail/cable.

2. The boat fender mounting device of claim 1 further including:

a second rope aperture defined in said planar member, said second rope aperture having an aperture width sufficient to receive said first end of said rope therethrough, said second rope aperture spaced apart from said first rope aperture for said first end of said rope to be passed first through said first rope aperture and then passed through said second rope aperture for fastening said rope to said planar member.

* * * * *